United States Patent [19]

Le Sueur

[11] 3,965,591

[45] June 29, 1976

[54] NAPKIN RING

[75] Inventor: Alice E. J. Le Sueur, Cobble Hill, Canada

[73] Assignee: The Raymond Lee Organization, New York, N.Y. ; a part interest

[22] Filed: Nov. 26, 1974

[21] Appl. No.: 527,216

[52] U.S. Cl. ..... 40/21 R

[51] Int. Cl.[2] ..... G09F 3/14

[58] Field of Search ..... 40/142 A, 63, 21 A, 40/21 B, 10; 63/2; 24/8

[56] References Cited

UNITED STATES PATENTS

| | | | |
|---|---|---|---|
| 198,065 | 12/1877 | Annin | 63/1 X |
| 2,600,505 | 6/1952 | Jones | 40/142 A |
| 2,653,402 | 9/1953 | Bonagura | 40/21 A |

FOREIGN PATENTS OR APPLICATIONS

| | | | |
|---|---|---|---|
| 1,308,888 | 10/1962 | France | 40/142 |

*Primary Examiner*—Louis G. Mancene
*Assistant Examiner*—Wenceslao J. Contreras
*Attorney, Agent, or Firm*—Howard I. Podell

[57] ABSTRACT

An open cylindrical napkin ring fitted with magnetic means for attaching an identifying name or set of initials in a recess on the outside of the ring.

3 Claims, 4 Drawing Figures

NAPKIN RING

SUMMARY OF THE INVENTION

My invention is an open cylindrical napkin ring fitted with magnetic means for attaching an identifying name or set of initials in a recess on the outside of the ring.

The magnetic means may be incorporated in a magnetic strip fastened in the external recess of the ring, with iron incorporated in the backing of each insert piece, marked with one or more identification symbols, that is attached to the magnetic strip in the recess.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
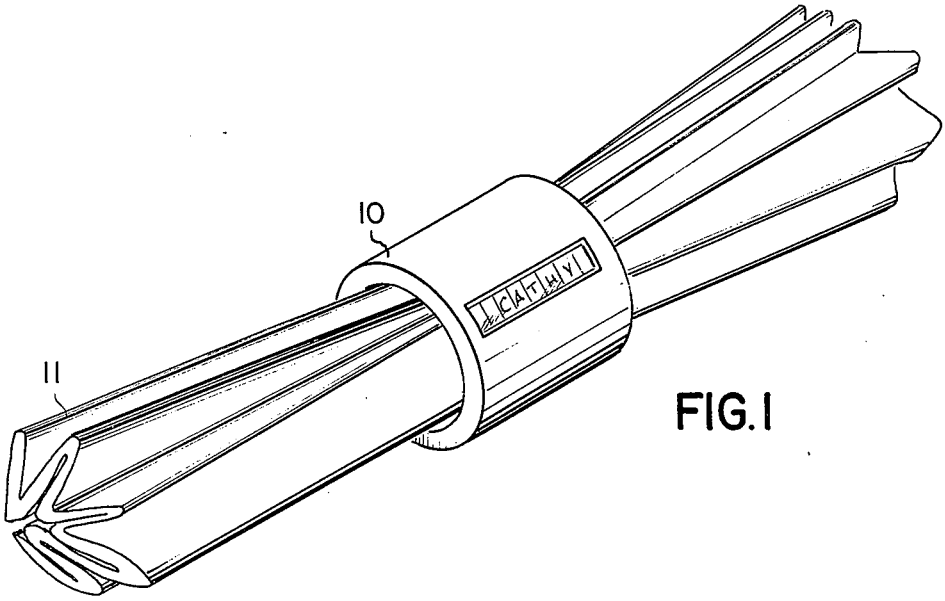
FIG. 1 is a perspective view of the invention in use.
Figure 2:
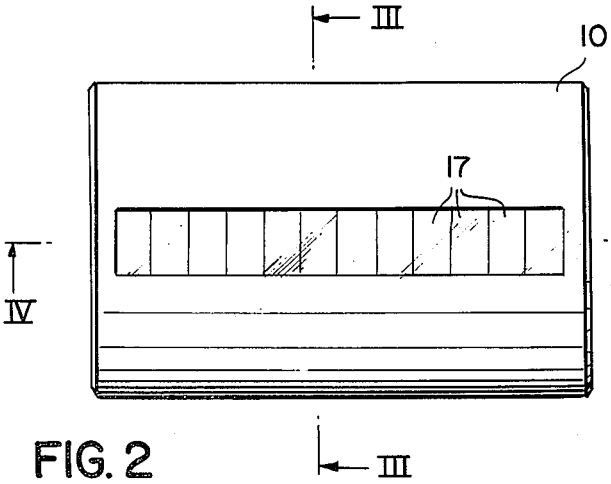
FIG. 2 is an elevation view of the invention.
Figure 3:
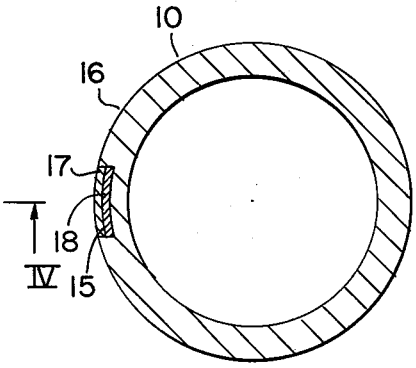
FIG. 3 is a sectional view taken along line III—III of FIG. 2.
Figure 4:
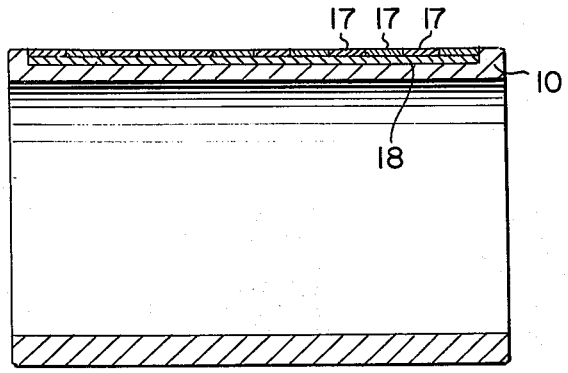
FIG. 4 is a sectional view taken along line IV—IV of FIG. 2.

Turning now descriptively to the drawings, in which similar reference characters denote similar elements throughout the several views, FIGS. 1–4 show the napkin ring 10 which may be mounted about a napkin 11.

The napkin ring 10 is formed in the shape of a hollow cylinder, preferably of a non-metallic material such as wood, with an exterior recess 15 mounted below the exterior surface 16 of the ring. A strip 18 of magnetic material is fastened to the base of the recess 15 below the surface 16 of the ring and individual plates 17 each externally marked with a letter or symbol are fastened to the strip 18. Each plate 17 is formed of a material which is magnetically attracted by the magnetic strip 18.

Alternately, each letter plate 17 may be formed of a magnetic material and strip 18 may be formed of a material magnetically attractable to such magnetic material.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A napkin ring in the form of a hollow cylinder fitted with readily replaceable and interchangeable identification means, comprising a hollow cylinder formed with a recess in an external face of the ring, a strip of material fixed in said recess below the external surface of the ring, and a plurality of plates, each externally marked with a symbol, that fit onto said strip in the recess, with said plates and strip joined to each other by magnetic means.

2. The combination as recited in claim 1 in which the strip is made of a magnetic material and each plate is made of a magnetically attractable material.

3. The combination as recited in claim 1 in which each plate is made of magnetic material and the strip is made of a magnetically attractable material.

* * * * *